United States Patent [19]

Casal

[11] Patent Number: 5,024,000

[45] Date of Patent: Jun. 18, 1991

[54] MATERIAL-REMOVAL WOODWORKING TOOL

[76] Inventor: André Casal, 84 B rue Ancienne, 1227 Carouge/Geneva, Switzerland

[21] Appl. No.: 493,976

[22] Filed: Mar. 15, 1990

[30] Foreign Application Priority Data

Mar. 21, 1989 [CH] Switzerland ..... 1043/89

[51] Int. Cl.[5] ..... B27C 1/10

[52] U.S. Cl. ..... 30/475; 30/477

[58] Field of Search ..... 30/475, 476, 477; 144/114 R, 117 C

[56] References Cited

U.S. PATENT DOCUMENTS 1,641,645 9/1927 Skolnik ..... 30/477

4,584,772 4/1986 Bergler ..... 30/475

*Primary Examiner*—W. Donald Bray

*Attorney, Agent, or Firm*—Kane, Dalsimer, Sullivan, Kurucz, Levy, Eisele and Richard

[57] ABSTRACT

The tool comprises a body (1) containing a motor driving a rotor, in particular provided with blades working through an orifice (14) formed between two guide pieces (10, 11). It is provided with two lateral handles (15, 16) situated in the extension of the rotor. The guides (10, 11) are removable and may, in particular, be convex in order to form an electric spokeshave. The orifice for discharging the shavings (19) is situated at the front and on the top of the rotor.

14 Claims, 2 Drawing Sheets

MATERIAL-REMOVAL WOODWORKING TOOL

FIELD OF THE INVENTION

The subject of the present invention is a material-removal woodworking tool comprising a body provided with gripping means and containing an electric motor driving a rotor carrying material-removal means projecting, when in rotation, through an opening arranged underneath said body.

PRIOR ART

Electric planes are known which are intended for the planing of plane surfaces and provided with a central handle extending in the direction of displacement of the plane. There is, however, no electrical tool for planing concave surfaces, the tool used being still the ancient spokeshave.

Furthermore, the known electrical sanders use either a belt rotating continuously or a vibrating plate on which an abrasive cloth or paper is fixed. These sanders are also designed exclusively for sanding plane surfaces.

The object of the present invention is to provide an electrical tool, which can be equipped as a plane or as a sander, enabling concave or convex surfaces and plane surfaces to be worked equally and consequently capable of forming, in particular, an electrical spokeshave.

SUMMARY OF THE INVENTION

The body of the tool according to the invention is provided with two removable guide pieces, the opposite parallel edges of which determine said opening, at least one of these guide pieces being adjustable, and the gripping means consist of two handles extending on either side of the body substantially rectilinearly and parallel to the axis of the rotor, along an axis passing inside the rotor.

The removable guide pieces may be pieces having convex or concave cylindrical surfaces or parallel plane surfaces, these guide pieces being interchangeable. If the rotor is provided with blades, then, depending on the guide pieces used, either a spokeshave or an electrical plane for plane surfaces is obtained. This rotor may, however, be replaced by a rotor intended to receive an abrasive sheet or band, which makes the tool into a sander.

The use of two handles arranged laterally enables the tool to be held in both hands, which enables the tool to be guided more accurately than the known electrical planes having only a central handle. Given the arrangement of the handles, it has been possible to provide the orifice for discharging the shavings judiciously between the handles, on top of and at the front of the rotor, which enables a better discharge of the shavings than in the known electrical planes where the discharge takes place laterally through an orifice with a relatively small cross-section, whereas the discharge orifice of the tool according to the invention may extend over the entire length of the rotor.

BRIEF DESCRIPTION OF THE DRAWINGS

Other advantages of the invention will emerge upon reading the description of an embodiment, given by way of example and described with reference to the attached drawings, in which.

DESCRIPTION OF THE PREFERRED EMBODIMENT

Figure 4:
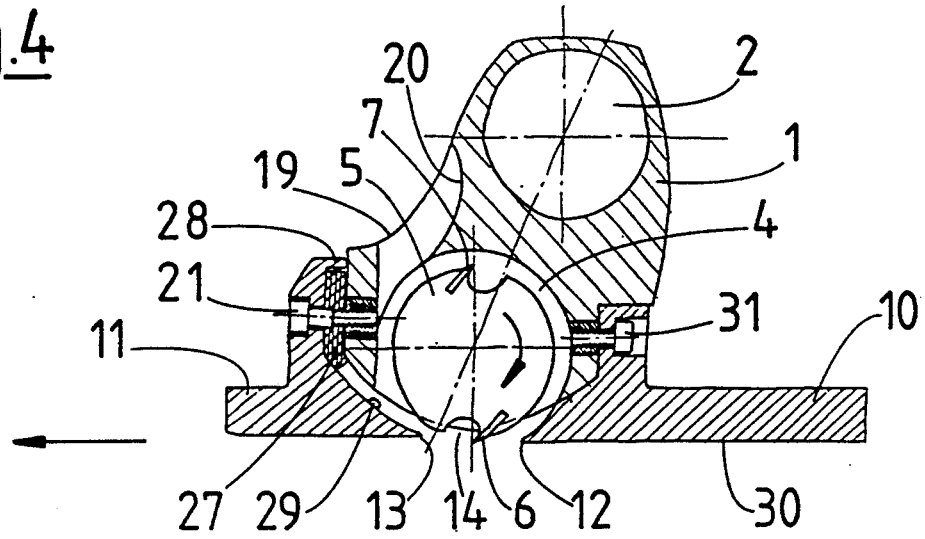
FIG. 4 is a view in radial cross-section along IV—IV in FIG. 2.

The tool shown comprises a body 1 made from a cast light metal alloy comprising in its upper part a cylindrical housing 2 (FIG. 4) for an electric motor, not shown, connected to the outside by vents 3. The lower part of the body 1 also has a cylindrical housing 4 wide open in its lower part and protecting a rotor 5 provided with two blades 6 and 7 and forming a plane. The body 1 is provided laterally with a plate 8 on which elements for transmitting the rotation of the motor to the rotor 5 are mounted. These transmission elements are protected by a cover 9. Two guide pieces 10 and 11, which will subsequently be simply designated by guides 10 and 11, are furthermore fixed on the body 1. These guides 10 and 11 have two lower parallel edges 12 and 13 which determine an opening 14 through which the cutters 6 and 7 of the rotor 5 can attack the surface to be planed.

The body 1 is furthermore provided with two handles 15 and 16 fixed laterally on either side of the body 1 and directed along an axis coinciding with the axis of the rotor 5. The axis of the handles 15 and 16 could, however, also be situated above or below the axis of the rotor 5. In all cases, the axis of the handles will traverse the rotor 5. The direction of rotation of the rotor 5 and the direction of displacement of the plane are indicated by arrows in the drawings. The handle 15 is therefore intended for the right hand, whereas the handle 16 is intended for the left hand. The handle 15 is provided with a control switch 17. The power cord 18 is connected to the end of the handle 15 and it is consequently entirely outside the trajectory of the tool, which reduces the risks of the cord being severed by the blades of the rotor. It is possible for this cord 18 to be capable of being plugged into the handle 15.

The body 1 has a discharge orifice 19 extending over virtually the entire length of the rotor, on top and to the rear of the latter, and relatively wide. This discharge orifice 19 consequently ensures an excellent discharge of the shavings. The discharge channel furthermore widens towards the outside with a curved surface 20 (FIG. 4), which contributes to eliminating the risk of clogging.

Figure 1:
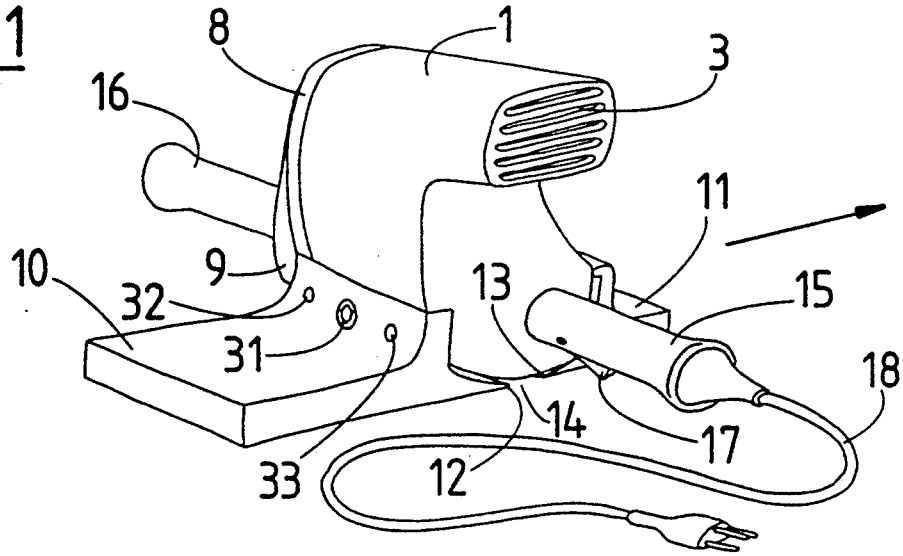
FIG. 1 is a perspective view of the tool seen from the side of the operator.
Figure 2:
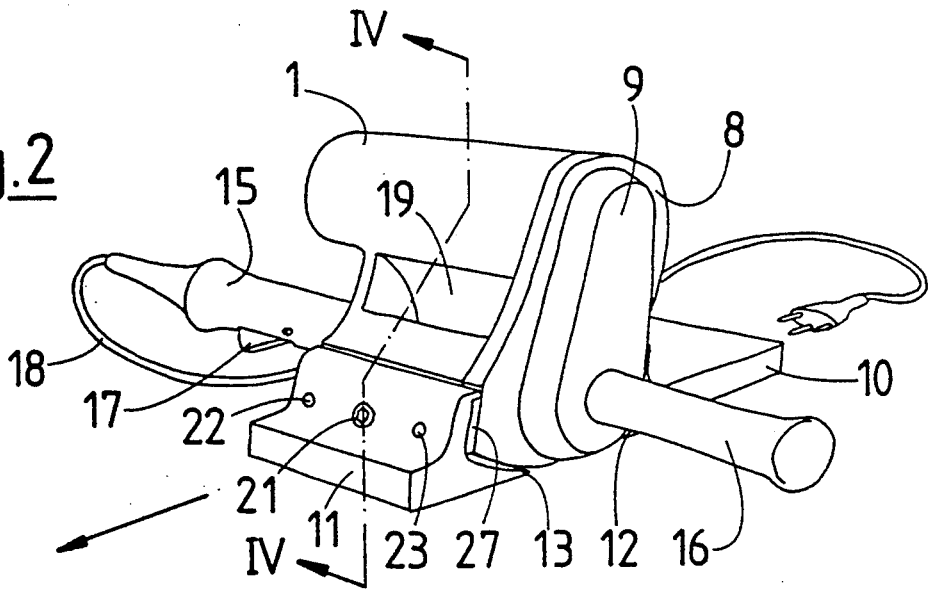
FIG. 2 is a perspective view of the same tool seen from the side opposite the operator.
Figure 3:
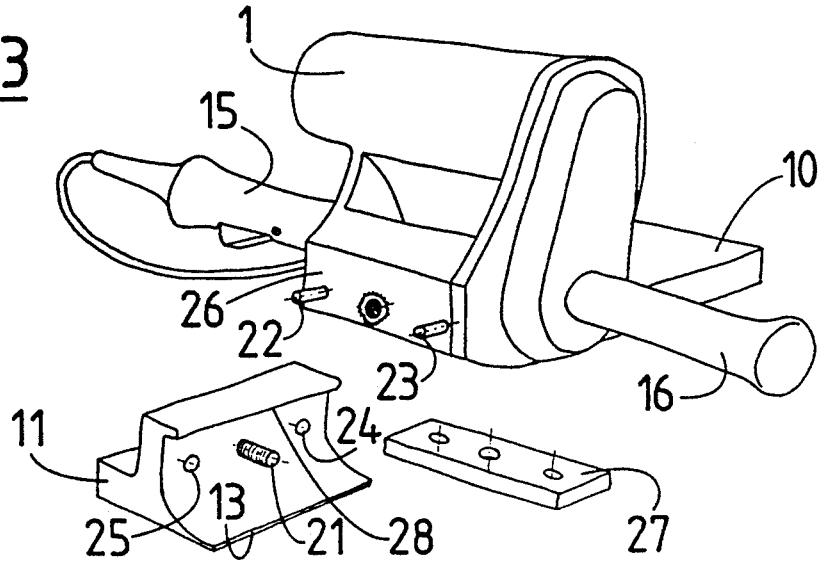
FIG. 3 is a view similar to that in FIG. 2 but with the guide piece removed.

The guide 11 is fixed to the body 1 by means of a screw 21 and it is furthermore guided by two pins 22 and 23 (FIG. 3) engaging with play into holes 24 and 25 respectively of the guide 11. An elastic element 27, for example made from rubber, is placed inbetween the guide 11 and the plane face 26 of the body 1. The body 1 and the guide 11 are rounded beneath the plane face 26. In its upper part, the guide 11 has a rim 28 bearing against the face 26 of the body. On its concave part, the guide 11 has a stop 29 (FIG. 4) intended to limit the compression of the elastic element 27 by abutting the body 1, and consequently to limit the rocking of the guide 11 about its bearing rim 28. It is thus possible by means of the screw 21 to alter the position of the edge 13 of the front guide 11, to be more precise to adjust the height of this edge 13 relative to the bearing face 30 of the rear guide 10, in other words to adjust the depth of the cut of the plane.

The rear guide 10 is fixed in the same manner as the guide 11, by means of a screw 31 and pins 32 and 33, but without any elastic elements inbetween.

Figure 5:
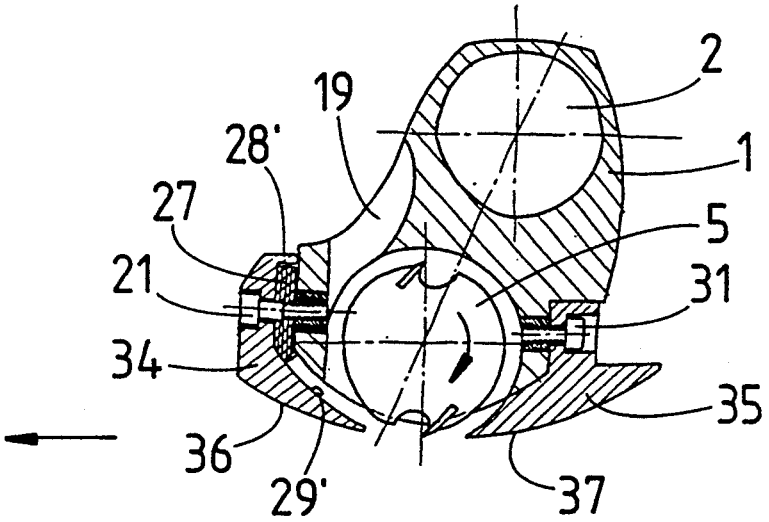
FIG. 5 is a cross-section similar to that in FIG. 4, but showing the tool equipped with convex guide pieces adjusted for a finishing cut.
Figure 6:
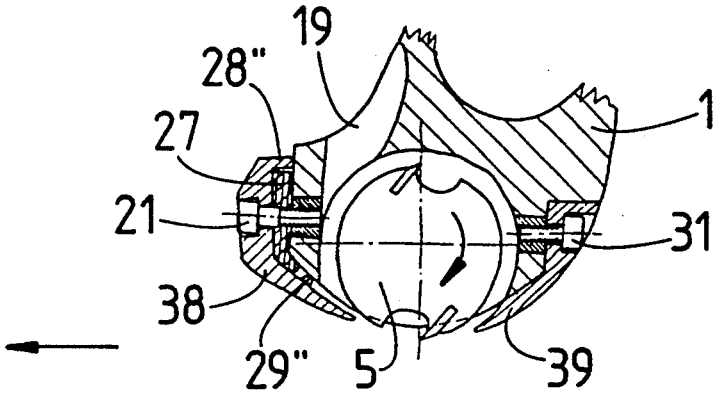
FIG. 6 is a view similar to that in FIG. 5, but equipped with convex guide pieces with a smaller radius, adjusted for a rough cut.

The plane guides 10 and 11 may be replaced by guides with different shapes, for example convex guides such as the guides 34 and 35 shown in FIGS. 5 and 6. These guides have a cylindrical convex lower face 36, and 37, respectively, approximately situated on the same cylindrical casing, this applying for a particular position of the front guide 34, which is adjustable in the manner of the guide 11 and having for this purpose a similar rim 28'. The rear guide 35 is fixed. When provided with the convex guides 34 and 35, the tool forms a spokeshave enabling concave surfaces to be planed. As for the plane guides, the depth of the cut is adjusted by means of the screw 21. The guides 34 and 35 may be replaced by guides whose convexity has a different radius in order to match the tool to the concavity of the surface to be planed. FIG. 6 shows the tool, used as a spokeshave, provided with guides 38 and 39 having a radius of curvature which is substantially smaller than that of the guides 34 and 35. The guide 38 is shown in the position of maximum adjustment of the cut, its stop 29" abutting the body 1 of the tool. When used as a spokeshave, the position of the handles 15 and 16 in the extension of the axis of the rotor 5 or close to this axis is particularly advantageous.

Since the guides can be exchanged for guides of different shapes, it will be possible to mount guides having any shapes which can be used for woodworking on the tool. In particular, it would be possible for the guides to have concave faces in order to work convex rounded surfaces.

The elastic element 27 could be replaced by springs. It could also be replaced by screws rigidly positioning the front guide.

The blade rotor 5 may be replaced by a rotor provided with a radial slot for the fastening of an abrasive band or sheet and coated with an elastic coating. The tool thus equipped therefore forms a sander. With the same tool it is therefore possible to plane a concave surface, and then to sand this surface.

I claim:

1. A material removal woodworking tool comprised of:

a) a body having an opening on its underside;

b) an electric motor;

c) a rotor driven by the motor, the rotor having an axis of rotation, the rotor being provided with means for removing material, the means projecting through the opening on the underside of the body;

d) two removable guide pieces, the guide pieces being arranged so that an edge of each of the guide pieces are parallel and opposite each other, thereby defining the opening, with at least one of the guide pieces being provided with adjustment means to permit adjustability;

e) gripping means attached to the body and extending on either side of the body forming an axis parallel to the axis of rotation of the rotor, the axis formed by the gripping means lying within the planar area formed by the outer dimensions of the rotor.

2. The tool as claimed in claim 1, wherein the axis of the handles (15, 16) coincides with the axis of the rotor.

3. The tool as claimed in claim 1, wherein the guide pieces have convex cylindrical outer faces (36, 37) situated at least approximately on a common cylindrical casing.

4. The tool as claimed in claim 1, wherein the guide pieces (10, 11) are plane and parallel.

5. The tool as claimed in claim 1, wherein at least one of the guide pieces has a concave outer face.

6. The tool as claimed in claim 1, wherein a power cord (18) of the motor enters the tool through the end of one of the handles and wherein this handle is provided with a control switch (17).

7. The tool as set forth in claim 1, wherein the body has an orifice for discharging cuttings of material, the orifice being situated upon the body between the handles, at the top and front of the rotor.

8. The tool as set forth in claim 1 wherein at least one of the guide pieces has a height adjustable lower edge and an upper edge for bearing and pivoting against the body, and an elastic means mounted between the guide piece and body, and a screw for fixedly engaging the guide piece and which permits adjustment when in a loosened position.

9. The tool as set forth in claim 1, wherein the axis of the handles is situated above the axis of the rotor.

10. The tool as set forth in claim 1, wherein the axis of the handles is situated below the axis of the rotor.

11. The tool as set forth in claim 1, wherein the rotor is provided with blades and forms a plane.

12. The tool as set forth in claim 1, wherein the rotor is provided with blades and forms a spokeshave.

13. The tool as set forth in claim 1, wherein the rotor has a longitudinal slot for fixing an abrasive cloth.

14. The tool as set forth in claim 1, wherein the rotor has a longitudinal slot for fixing an abrasive paper.

* * * * *